US011028709B2

(12) United States Patent
Subramanian et al.

(10) Patent No.: US 11,028,709 B2
(45) Date of Patent: Jun. 8, 2021

(54) AIRFOIL SHROUD ASSEMBLY USING TENON WITH EXTERNALLY THREADED STUD AND NUT

(71) Applicant: General Electric Company, Schenectady, NY (US)

(72) Inventors: Vasantharuban Subramanian, Bengaluru (IN); Ronald Denmark, Greenville, SC (US); Prem Navin Dhayanandam, Bengaluru (IN); Richard Gutta, Greenville, SC (US); Sanjeev Kumar Jha, Bengaluru (IN)

(73) Assignee: General Electric Company, Schenectady, NY (US)

( * ) Notice: Subject to any disclaimer, the term of this patent is extended or adjusted under 35 U.S.C. 154(b) by 130 days.

(21) Appl. No.: 16/134,344

(22) Filed: Sep. 18, 2018

(65) Prior Publication Data

US 2020/0088049 A1 Mar. 19, 2020

(51) Int. Cl.
*F01D 9/04* (2006.01)
*F01D 25/28* (2006.01)

(52) U.S. Cl.
CPC ..... *F01D 9/042* (2013.01); *F01D 25/28* (2013.01); *F05D 2240/12* (2013.01); *F05D 2250/281* (2013.01); *F05D 2260/31* (2013.01)

(58) Field of Classification Search
CPC ..... F01D 9/042; F01D 25/28; F05D 2240/12; F05D 2250/281; F05D 2260/31
See application file for complete search history.

(56) References Cited

U.S. PATENT DOCUMENTS 1,998,951 A * 4/1935 Downer ..... F01D 9/042 415/209.4
2,654,566 A * 10/1953 Boyd ..... F01D 9/042 415/137
2,755,064 A * 7/1956 Simonsen ..... F01D 9/042 415/209.3
2,957,228 A * 10/1960 Stoddard ..... B23P 15/02 29/889.22
3,781,125 A * 12/1973 Rahaim ..... F01D 9/041 415/115

(Continued)

FOREIGN PATENT DOCUMENTS

CA 2976930 A1 * 2/2018 ..... F04D 29/542
FR 2674909 A1 * 10/1992 ..... F01D 9/042

(Continued)

OTHER PUBLICATIONS

Machine Translation of FR2674909A1 (Year: 1991).*

(Continued)

*Primary Examiner* — Ninh H. Nguyen
*Assistant Examiner* — Brian Christopher Delrue
(74) *Attorney, Agent, or Firm* — Charlotte Wilson; Hoffman Warnick LLC

(57) ABSTRACT

An airfoil and shroud assembly includes an airfoil including a root end, a free end and a tenon extending from the free end, the tenon including a base and an externally threaded stud extending from the base. A shroud includes an opening configured to receive the base of the tenon. A nut is configured to be threadably coupled to the externally threaded stud on the tenon on the airfoil to couple the shroud to the airfoil.

6 Claims, 8 Drawing Sheets

(56) References Cited

U.S. PATENT DOCUMENTS 3,849,023 A * 11/1974 Klompas ..... F01D 9/042 415/173.7
3,887,976 A * 6/1975 Sheilds ..... B23P 11/02 29/889.22
3,952,563 A * 4/1976 Yamashita ..... E05B 47/0038 70/232
4,144,755 A * 3/1979 Palloch ..... F16H 55/36 403/16
4,245,954 A * 1/1981 Glenn ..... F01D 5/284 415/200
4,384,822 A * 5/1983 Schweikl ..... F01D 9/042 415/115
4,566,851 A * 1/1986 Comeau ..... F01D 25/246 415/139
4,710,097 A * 12/1987 Tinti ..... F01D 25/246 415/138
4,856,962 A * 8/1989 McDow ..... F01D 17/162 415/115
5,078,576 A * 1/1992 Hayton ..... F01D 5/3084 415/134
5,133,643 A * 7/1992 Ortolano ..... F01D 5/225 269/43
5,211,537 A * 5/1993 Langston ..... F01D 9/042 415/209.2
5,236,304 A * 8/1993 Charbonnel ..... F01D 9/044 415/191
5,328,327 A * 7/1994 Naudet ..... F01D 17/162 29/889.22
5,343,694 A * 9/1994 Toborg ..... F01D 9/042 60/796
5,421,703 A * 6/1995 Payling ..... F01D 9/042 415/209.3
5,517,817 A * 5/1996 Hines ..... F01D 17/162 415/115
5,634,768 A * 6/1997 Shaffer ..... F01D 9/042 415/137
6,161,822 A * 12/2000 Hurst ..... B60G 13/003 188/321.11
6,379,162 B1 * 4/2002 Raypole ..... H01R 33/7664 188/282.2
6,413,043 B1 * 7/2002 Bouyer ..... F01D 9/042 29/451
7,311,495 B2 * 12/2007 Ashley ..... F01D 5/26 415/209.4
7,722,321 B2 * 5/2010 Lhoest ..... F01D 9/042 415/209.3
7,862,296 B2 * 1/2011 Finneran ..... F01D 9/042 415/209.3
7,997,860 B2 * 8/2011 Burdgick ..... F01D 1/02 415/191
8,092,165 B2 * 1/2012 Bouchard ..... F01D 9/02 29/889.22
8,206,100 B2 6/2012 Schuler et al.
8,702,385 B2 * 4/2014 Burdgick ..... F01D 9/02 29/889.22
8,834,105 B2 * 9/2014 Albers ..... F01D 11/005 415/173.1
9,045,985 B2 * 6/2015 Feigleson ..... F01D 9/042
9,322,286 B2 * 4/2016 Digard Brou De Cuissart ..... F01D 9/041
9,587,498 B2 * 3/2017 Oden ..... F01D 9/02
9,810,083 B2 * 11/2017 Oden ..... F01D 9/02
10,060,449 B2 * 8/2018 I ..... F04D 29/541
2007/0107218 A1 * 5/2007 Poccia ..... F01D 9/042 29/889.2
2011/0078902 A1 * 4/2011 Durocher ..... F01D 25/16 29/889.2
2011/0232071 A1 * 9/2011 Knoop ..... F03D 80/00 29/525.02
2011/0286847 A1 * 11/2011 King ..... F01D 9/042 416/179
2011/0286851 A1 * 11/2011 Benkler ..... F01D 9/042 416/223 R
2012/0111023 A1 * 5/2012 Sjoqvist ..... F01D 9/04 60/797
2012/0163979 A1 * 6/2012 Darkins, Jr. ..... F01D 5/3092 416/223 R
2012/0233837 A1 * 9/2012 Bartlam ..... F01D 9/042 29/426.1
2012/0282088 A1 * 11/2012 Stiehler ..... F04D 29/644 415/209.2
2013/0336794 A1 * 12/2013 Armstrong ..... F01D 9/00 416/189
2015/0192140 A1 * 7/2015 Derclaye ..... F04D 29/023 415/200
2015/0226116 A1 * 8/2015 Major ..... F02C 7/36 60/796
2016/0108812 A1 * 4/2016 Rogers ..... F01D 25/246 60/805
2017/0363100 A1 * 12/2017 Ulrichsohn ..... C10M 103/06
2018/0017074 A1 * 1/2018 Shanti ..... F04D 29/644
2018/0080332 A1 * 3/2018 Got ..... F01D 5/282
2018/0216632 A1 * 8/2018 Conner ..... F01D 9/041
2019/0145423 A1 * 5/2019 Husband ..... F01D 5/225 60/226.1

FOREIGN PATENT DOCUMENTS

GB 676784 A * 8/1952 ..... C06F 5/00
GB 1387866 A * 3/1975 ..... F01D 9/042
GB 2486964 A * 7/2012 ..... F01D 25/12

OTHER PUBLICATIONS

Standard Handbook for Mechanical Engineers (7th Edition) by Theodore Baumeister (Editor), Lionel S. Marks (Editor), McGraw-Hill, Inc., Published 1967, pp. 5-68 to 5-69. (see attachment) (Year: 1967).*

* cited by examiner

AIRFOIL SHROUD ASSEMBLY USING TENON WITH EXTERNALLY THREADED STUD AND NUT

BACKGROUND OF THE INVENTION

The disclosure relates generally to turbomachines, and more particularly, to an airfoil shroud assembly including a tenon with an externally threaded stud for coupling airfoil shrouds to an airfoil in a turbomachine.

Turbomachines include one or more rows of airfoils, including stator vanes including stationary airfoils and rotor blades or buckets including rotating airfoils. Turbomachines can take a variety of forms such as gas turbines, jet engines, steam turbines and compressors. A gas turbine system, for example, may include an axial compressor at the front, one or more combustors around the middle, and a turbine at the rear. An axial compressor, for example, has a series of stages with each stage comprising a row of rotor blades followed by a row of stationary stator vanes. Accordingly, each stage generally comprises a set of rotor blades and stator vanes. In an axial compressor, the rotor blades increase the kinetic energy of a fluid that enters through an inlet and the stator vanes convert the increased kinetic energy of the fluid into static pressure through diffusion. Accordingly, both sets of airfoils play a vital role in increasing the pressure of the fluid. Similar dynamics are observed in other forms of turbomachines in which the kinetic energy of a working fluid that enters the turbomachine through an inlet is converted to rotational energy by the rotor blades as the stator vanes direct the kinetic energy of the working fluid into the rotor blades. In any system, the type of working fluid may vary depending on the type of turbomachine, e.g., air in a compressor, combustion gases in gas turbine, steam in a steam turbine, etc.

In the case of stator vanes, the set of airfoils is connected at the base of the airfoils to form the segment and may also be connected to the adjacent airfoils in the segment by an inner shroud. In many applications, it is not practical to manufacture an integral base, stator vane, and vane shroud. Thus, each stator vane in the segment may be produced independently, often including an integral base section, and assembled into the complete set. The shroud may be produced as one or more separate components that are attached to the inward facing ends of the stator vanes. In some embodiments, a single vane shroud is provided for each stator vane. In other embodiments, multiple adjacent stator vanes may be attached to a multi-vane shroud. Coupling of multiple adjacent stator vanes may help address vortex bursting or breakdown, which is an abrupt change in flow structure of swirling working fluid as the working fluid moves through the turbomachine that can cause undesirable vibrations in the machine. In some turbomachines, such as axial compressors, vortex bursting can present challenges for cantilevered stationary vanes because it can hinder operation at certain cold ambient temperatures and/or at part load conditions.

A stator vane, vane shroud, and one or more additional attachment components, such as bolts, bushings, washers, nut and other components may be referred to as a vane shroud assembly. The vane and shroud may each include features for engagement and attachment to each other. In some arrangements, the vane incorporates a tenon, or extension from the end of the airfoil, which extends into and/or through a compatible opening in the shroud, and a bushing is also inserted into the opening in the shroud and secured with an externally threaded bolt coupled to the tenon to attach the shroud to the vane. Assembling shrouds on stationary vanes with this type arrangement can pose a challenge on smaller turbomachines because space constraints prevent easy access. One current approach employs small externally threaded bolts that thread into internally threaded tenons on the stationary vanes to hold the shroud to the vanes. This approach is difficult to implement in the small spaces within smaller turbomachines, and presents concerns about durability.

BRIEF DESCRIPTION OF THE INVENTION

A first aspect of the disclosure provides an airfoil and shroud assembly, comprising: an airfoil including a root end, a free end and a tenon extending from the free end, the tenon including a base and an externally threaded stud extending from the base; a shroud including an opening configured to receive the base of the tenon; and a nut configured to be threadably couple to the externally threaded stud on the tenon on the airfoil to couple the shroud to the airfoil.

A second aspect of the disclosure provides a vane for a turbomachine, the vane comprising: an airfoil body including a free end and a root end, the root end configured to be mounted to an outer casing of the turbomachine; and a tenon extending from a free end of the airfoil body, the tenon including: a base configured to be received in an opening in a shroud and an externally threaded stud extending from the base.

A third aspect of the disclosure provides a turbomachine, comprising: an outer casing surrounding a rotor; a plurality of vanes, each vane including: an airfoil body having a radially outer end coupled to the outer casing and extending inwardly toward the rotor to a radially inner end, and a tenon extending from the radially inner end, the tenon including a base and an externally threaded stud extending from the base; a shroud including a plurality of openings to receive the base the tenon of each of a set of the plurality of vanes; and a nut threadably coupled to each of the externally threaded studs on the tenons for coupling the shroud to the set of the plurality of vanes.

A fourth aspect of the disclosure relates to a vane and shroud assembly, comprising: a vane including an airfoil body including a root end, a free end and a tenon extending from the free end, wherein the root end is configured to be coupled to an outer casing of a turbomachine, and the free end extends radially inward toward a rotor of the turbomachine, and wherein the tenon includes a base and an externally threaded stud extending from the base; a shroud including an opening; a bushing having a first internal opening to receive the base of the tenon, a second internal opening allowing the externally threaded stud to pass therethrough, and an external surface configured to engage an inner surface of the opening in the shroud; and a nut configured to be threadably couple to the externally threaded stud on the tenon on the airfoil body to couple the shroud to the airfoil.

The illustrative aspects of the present disclosure are designed to solve the problems herein described and/or other problems not discussed.

BRIEF DESCRIPTION OF THE DRAWINGS

These and other features of this disclosure will be more readily understood from the following detailed description of the various aspects of the disclosure taken in conjunction with the accompanying drawings that depict various embodiments of the disclosure, in which.

It is noted that the drawings of the disclosure are not to scale. The drawings are intended to depict only typical aspects of the disclosure, and therefore should not be considered as limiting the scope of the disclosure. In the drawings, like numbering represents like elements between the drawings.

DETAILED DESCRIPTION OF THE INVENTION

Figure 1:
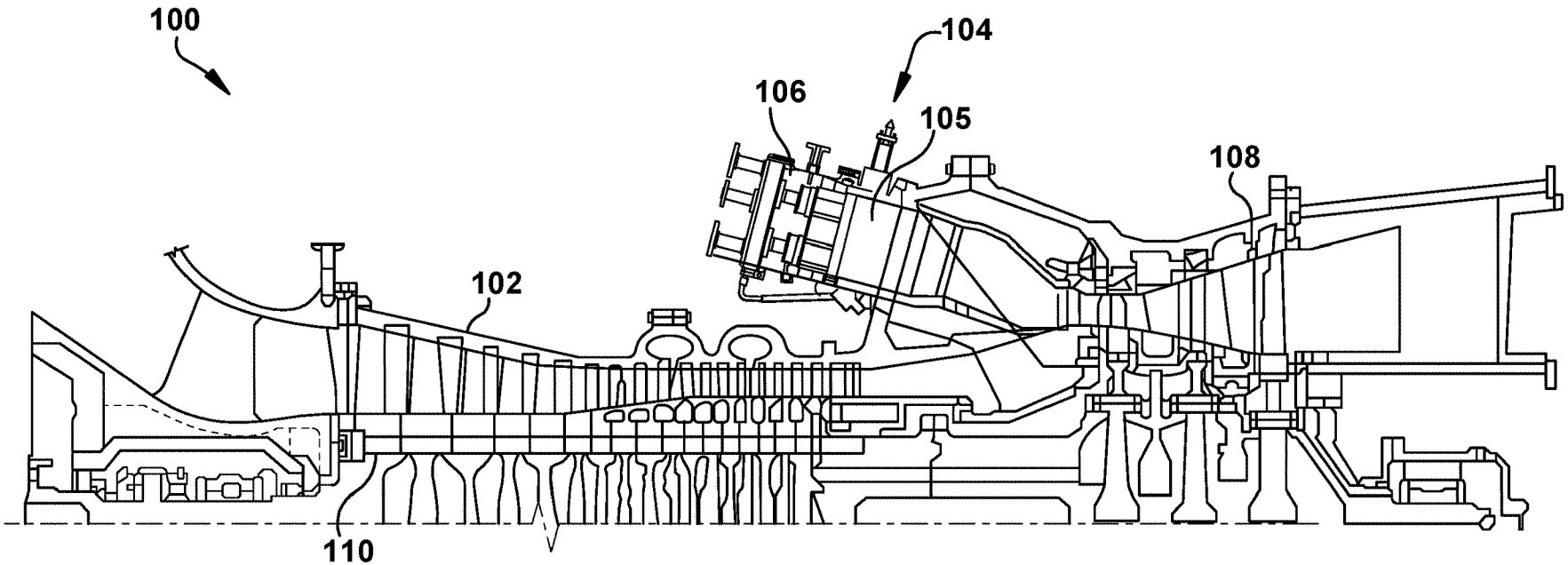
FIG. 1 is a schematic illustration of an illustrative turbomachine in the form of a gas turbine system.

As an initial matter, in order to clearly describe the current disclosure it will become necessary to select certain terminology when referring to and describing relevant machine components within a turbomachine. When doing this, if possible, common industry terminology will be used and employed in a manner consistent with its accepted meaning. Unless otherwise stated, such terminology should be given a broad interpretation consistent with the context of the present application and the scope of the appended claims. Those of ordinary skill in the art will appreciate that often a particular component may be referred to using several different or overlapping terms. What may be described herein as being a single part may include and be referenced in another context as consisting of multiple components. Alternatively, what may be described herein as including multiple components may be referred to elsewhere as a single part.

In addition, several descriptive terms may be used regularly herein, and it should prove helpful to define these terms at the onset of this section. These terms and their definitions, unless stated otherwise, are as follows. As used herein, "downstream" and "upstream" are terms that indicate a direction relative to the flow of a fluid, such as the working fluid through the turbine engine or, for example, the flow of air through a compressor. The term "downstream" corresponds to the direction of flow of the fluid, and the term "upstream" refers to the direction opposite to the flow. The terms "forward" and "aft," without any further specificity, refer to directions, with "forward" referring to the front or compressor end of the engine, and "aft" referring to the rearward or turbine end of the engine. It is often required to describe parts that are at differing radial positions with regard to a center axis. The term "radial" refers to movement or position perpendicular to an axis. In cases such as this, if a first component resides closer to the axis than a second component, it will be stated herein that the first component is "radially inward" or "inboard" of the second component. If, on the other hand, the first component resides further from the axis than the second component, it may be stated herein that the first component is "radially outward" or "outboard" of the second component. The term "axial" refers to movement or position parallel to an axis. Finally, the term "circumferential" refers to movement or position around an axis. It will be appreciated that such terms may be applied in relation to the center axis of the turbine.

Where an element or layer is referred to as being "on," "engaged to," "disengaged from," "connected to" or "coupled to" another element or layer, it may be directly on, engaged, connected or coupled to the other element or layer, or intervening elements or layers may be present. In contrast, when an element is referred to as being "directly on," "directly engaged to," "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

As indicated above, the disclosure provides an airfoil and shroud assembly including an airfoil including a root end, a free end and a tenon extending from the free end. In contrast to conventional assemblies, the tenon includes a base and an externally threaded stud extending from the base. A shroud includes an opening configured to the base of the tenon. A nut is configured to be threadably coupled to the externally threaded stud on the tenon on the airfoil to couple the shroud to the airfoil. The airfoil and shroud assembly provides a stronger and more durable coupling. Further, the airfoil shroud assembly reduces vortex bursting and dampens response to secondary flow vibration, and reduces the impact of cold ambient or part load operations on certain turbomachines, such as an axial compressor.

FIG. 1 is a schematic view of an illustrative turbomachine in the form of a gas turbine system 100. System 100 includes a compressor 102 and a combustor 104. Combustor 104 includes a combustion region 105 and a fuel nozzle assembly 106. System 100 also includes a turbine 108 and a common compressor/turbine shaft 110 (sometimes referred to as rotor 110). In one embodiment, engine 100 is a MS7001FB engine, sometimes referred to as a 9FB engine, commercially available from General Electric Company, Greenville, S.C. The present disclosure is not limited to any one particular engine and may be implanted in connection with other gas turbines and turbomachines.

In operation, air flows through compressor 102 and compressed air is supplied to combustor 104. Specifically, the compressed air is supplied to fuel nozzle assembly 106 that is integral to combustor 104. Assembly 106 is in flow communication with combustion region 105. Fuel nozzle assembly 106 is also in flow communication with a fuel source (not shown in FIG. 1) and channels fuel and air to combustion region 105. Combustor 104 ignites and combusts fuel. Combustor 104 is in flow communication with turbine 108 for which gas thermal energy is converted to mechanical rotational energy. Turbine 108 is rotatably coupled to and drives rotor 110. Compressor 102 also is rotatably coupled to shaft 110.

Figure 2:
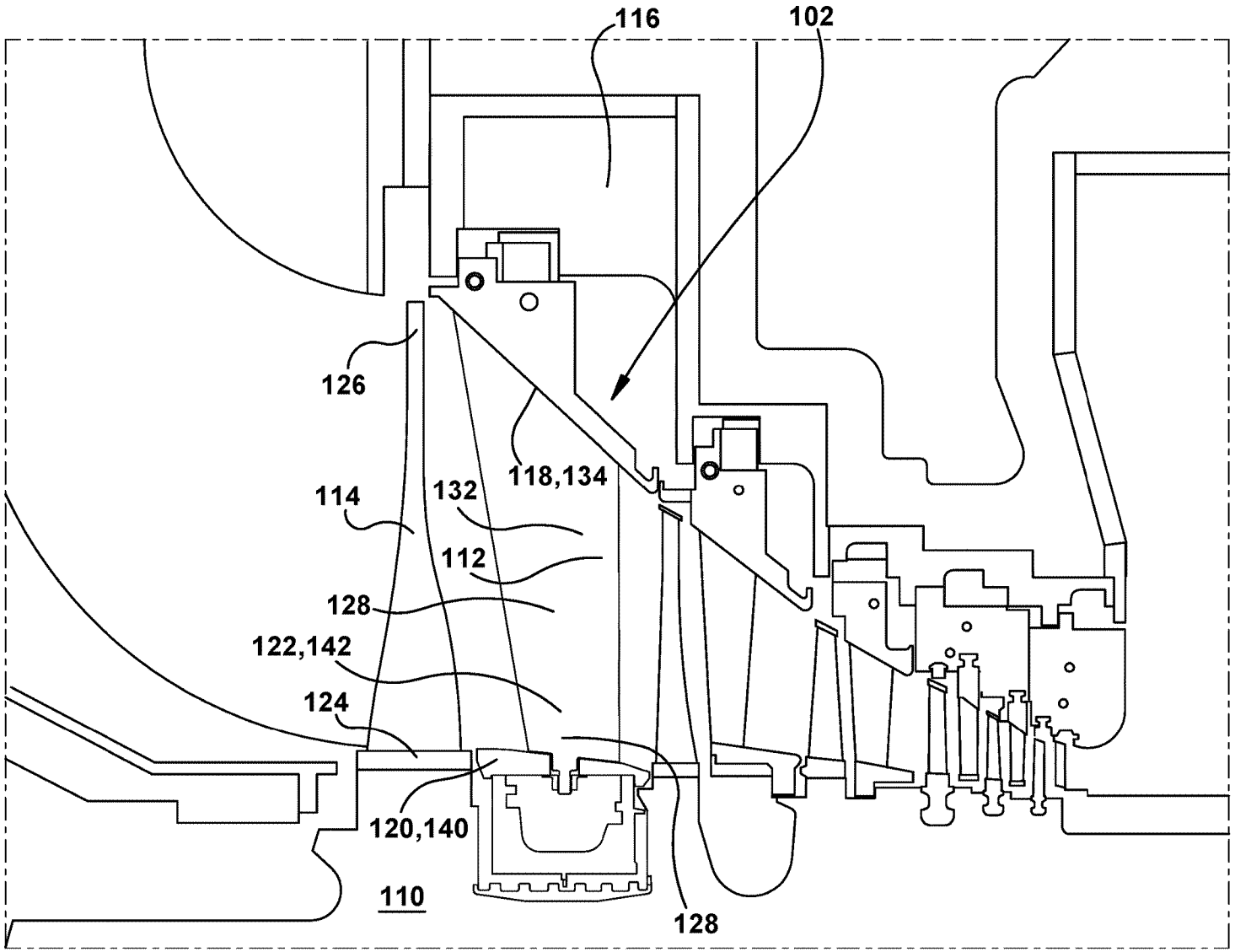
FIG. 2 is a cross-section illustration of an illustrative compressor assembly that may be used with the gas turbine in FIG. 1.

FIG. 2 shows a cross-section illustration of an illustrative compressor assembly 102 that may be used with gas turbine system 100 in FIG. 1. Compressor assembly 102 includes vanes 112 and rotor blades 114. Each vane 112 is held in compressor assembly 108 fixed to an outer casing 116 by a radially outer, root end 118, and includes a shroud 120 on a radially inner, free end 122. Rotor blades 114 include a radially inner root end or base 124 fixed to rotor 110, and free radially outer end 126. Teachings of the disclosure will be described relative to an airfoil free end 122 in the form of a vane 112. In this case, root end 118 is configured to be coupled to outer casing 116 of the turbomachine, and a free end 128 extends radially inward toward rotor 110 of the turbomachine. However, it is emphasized that teachings of the disclosure may be applicable to airfoils for rotor blades 114 also. Further, while teachings of the disclosure will be described relative to compressor assembly 108, an airfoil shroud assembly 130 according to embodiments of the disclosure may be applied to a variety of turbomachines including, for example, a gas turbine assembly, a steam turbine, jet engine, etc.

Figure 3:
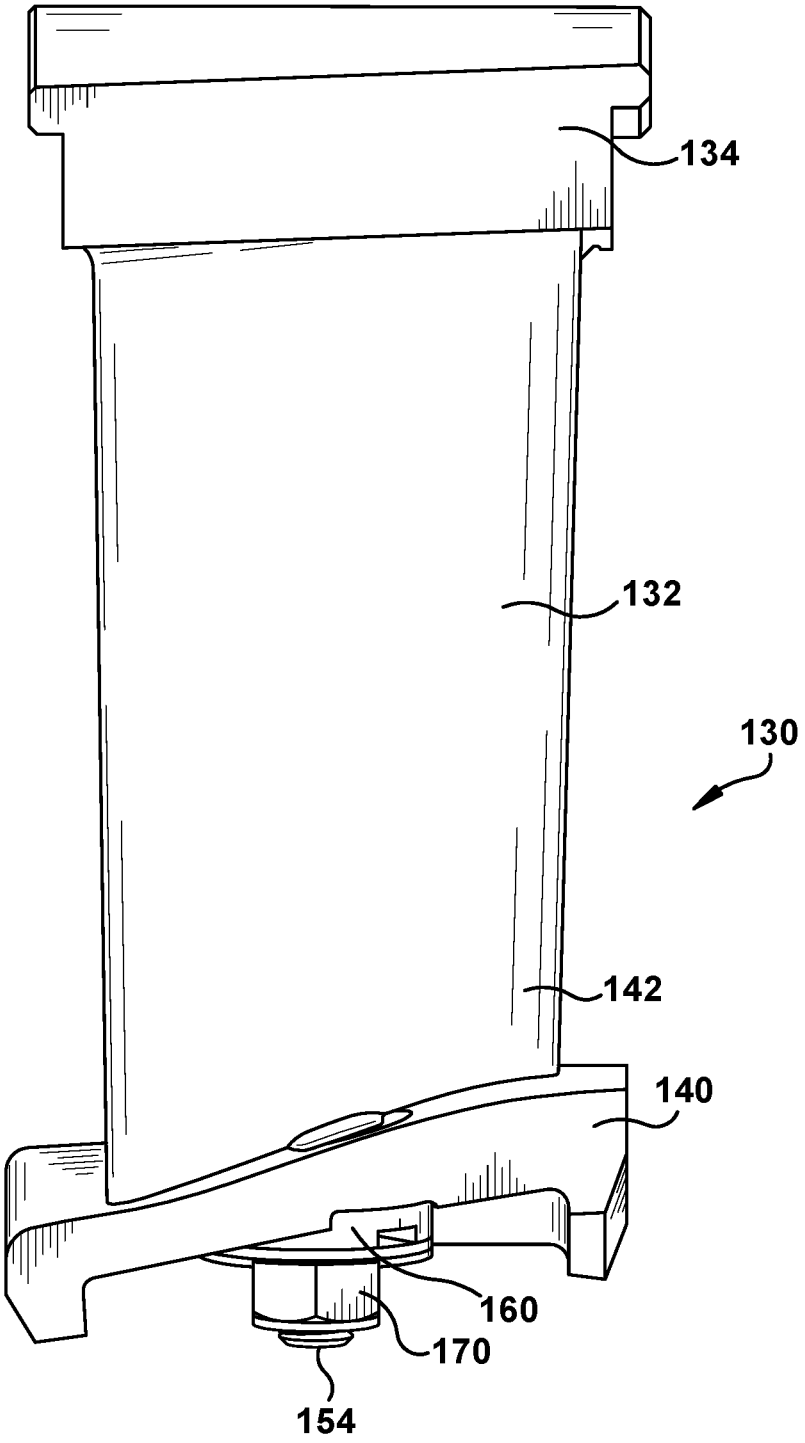
FIG. 3 is a front view of an airfoil shroud assembly for a single airfoil body according to embodiments of the disclosure.
Figure 4:
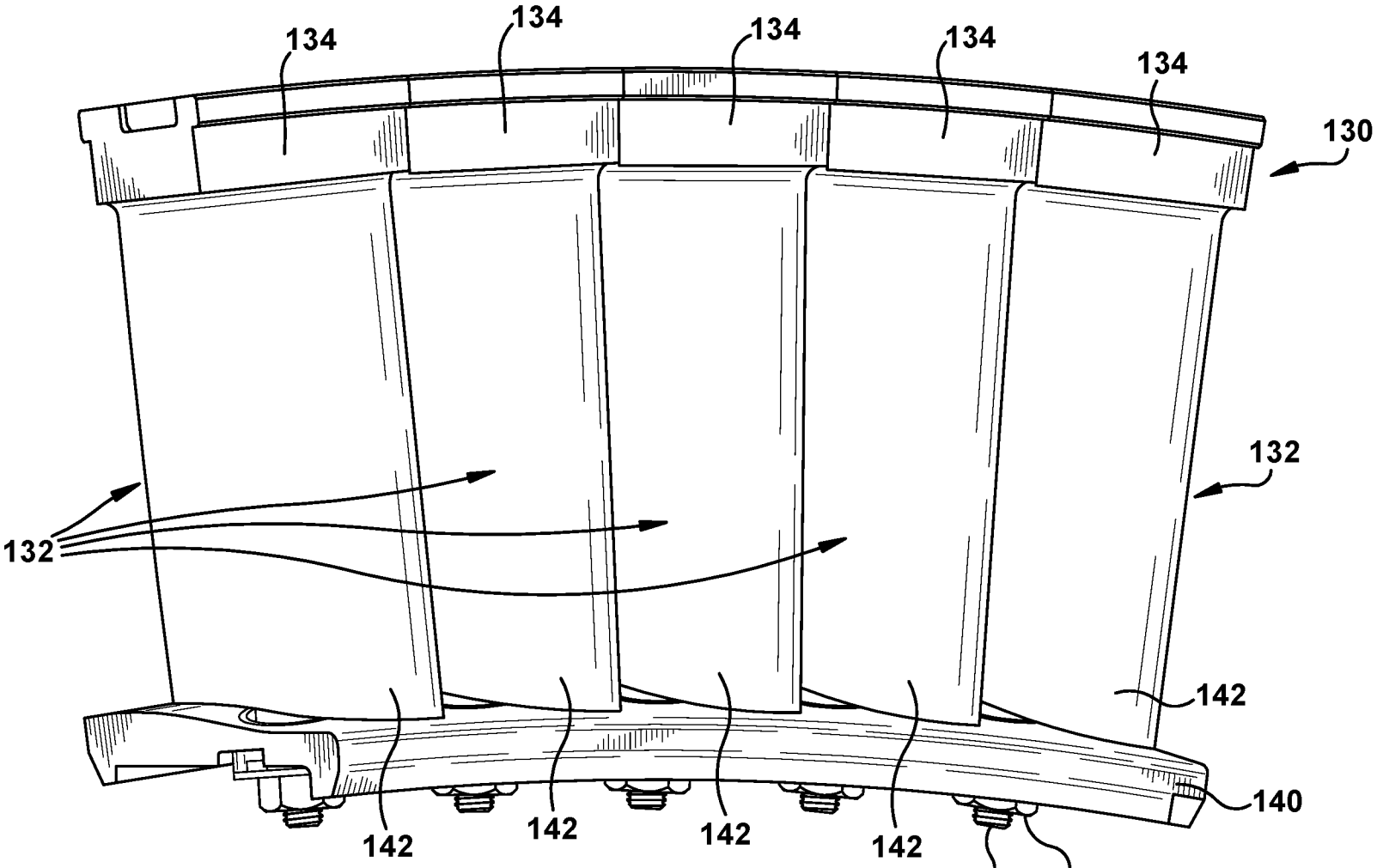
FIG. 4 is a front view of an airfoil shroud assembly for a multiple airfoil bodies according to embodiments of the disclosure.

FIGS. 3 and 4 show an example airfoil shroud assembly 130 in various views. Airfoil shroud assembly 130 includes various components that are assembled and attached to couple an airfoil(s) to a shroud and form the installed airfoil shroud assembly 130. FIG. 3 shows an airfoil shroud assembly 130 for a single airfoil body 132, and FIG. 4 shows an airfoil shroud assembly 130 for a number of airfoil bodies 132. Each airfoil body 132 includes an integral root end or base 134 for fixed coupling, e.g., to an outer casing 116 (FIG. 2). For simplicity, only a single airfoil shroud assembly 130, including a single airfoil body 132 with integral root end or base 134 is shown in most figures without the ring, adjacent airfoils, and other turbomachine components with which it would be assembled in an actual installation.

Figure 5:
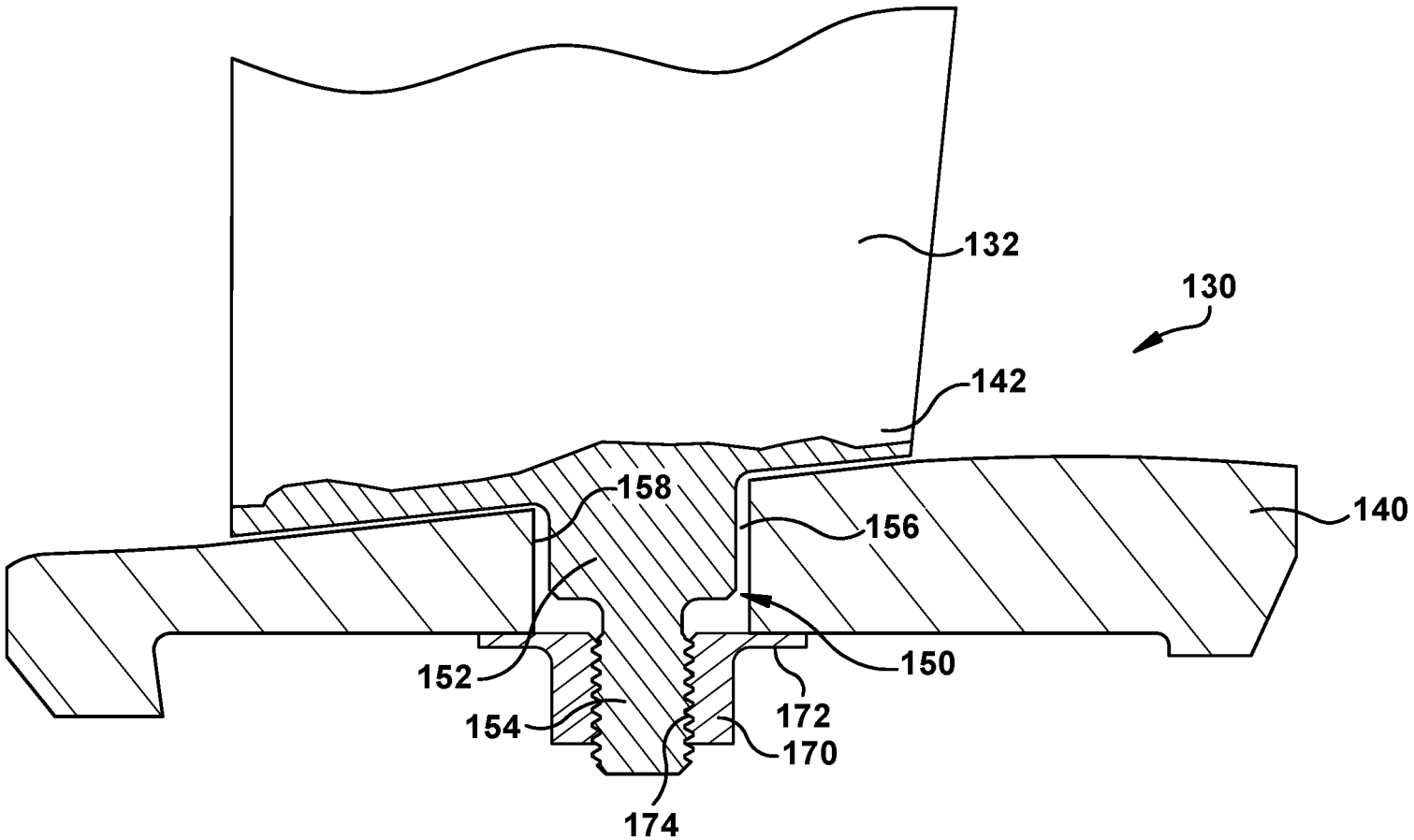
FIG. 5 is an enlarged cross-sectional view of an airfoil shroud assembly according to embodiments of the disclosure.
Figure 6:
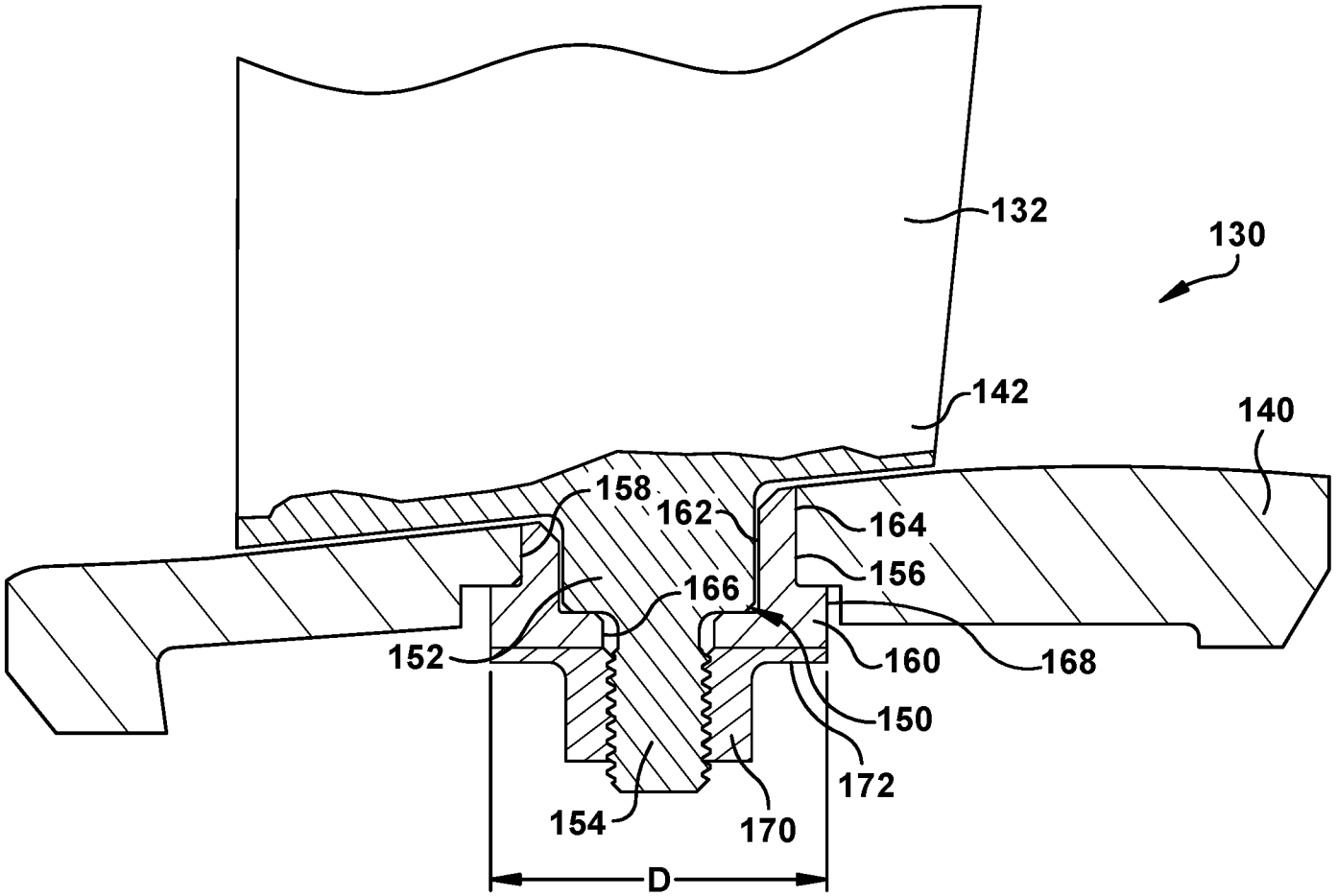
FIG. 6 is an enlarged cross-sectional view of an airfoil shroud assembly according to another embodiment of the disclosure.

As shown in the enlarged cross-sectional view of FIG. 5, airfoil shroud assembly 130 includes airfoil body 132 including root end 134 (FIG. 3), free end 142 and tenon 150 extending from free end 142. Tenon 150 includes a base 152 and, in contrast to conventional arrangements, an externally threaded stud 154 extending from base 152. In one embodiment, shown in FIG. 5, shroud 140 includes an opening 156 configured to receive base 152 of tenon 150, i.e., base 152 and/or externally threaded stud 154 therethrough. In this embodiment, base 152 may engage an inner surface 158 of opening 156. Alternatively, as shown in FIG. 6, airfoil shroud assembly 130 may include a bushing 160 having a first internal opening 162 to receive base 152 of tenon 150, and an external surface 164 configured to engage inner surface 158 of opening 156 in shroud 140. Bushing 160 may also include a second internal opening 166 allowing externally threaded stud 154 to pass therethrough. Bushing 160 provides lateral spacing between the other components, and may include various configurations of lateral contact and non-contact surfaces between adjacent components. As shown best in FIG. 8, shroud 140 is installed on free end 142 by placement of opening 156 over base 152 of tenon 150 of airfoil body 132. Where provided, bushing 160 can be positioned over tenon 150 to laterally (e.g., concentrically) position opening 156 about bushing 160 and base 152.

Figure 7:
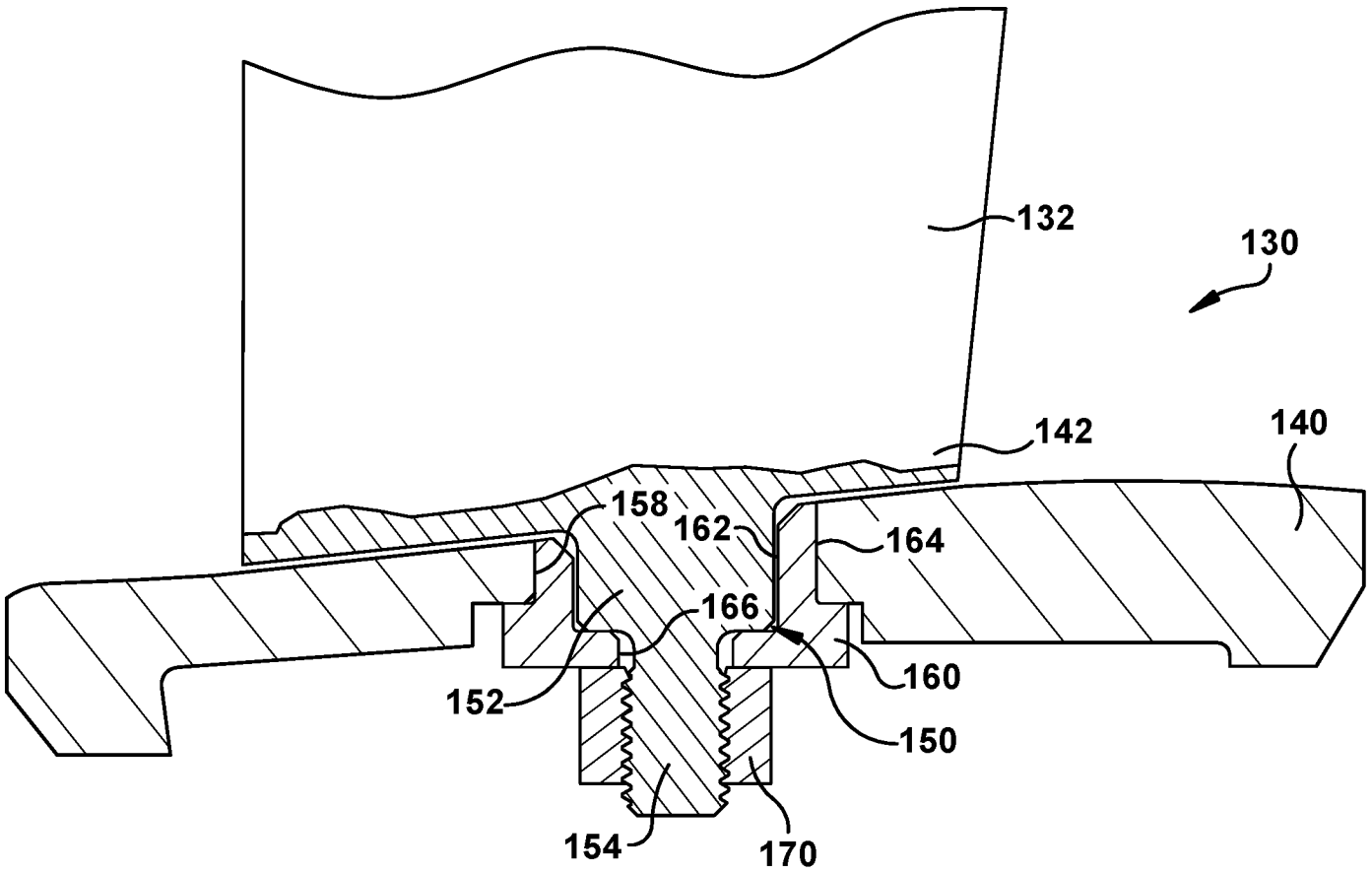
FIG. 7 is an enlarged cross-sectional view of an airfoil shroud assembly according to another embodiment of the disclosure.

Airfoil shroud assembly 130 also includes a nut 170 configured to be threadably couple to externally threaded stud 154 on tenon 150 on airfoil body 132 to couple shroud 140 to airfoil body (or bodies) 132. Nut 170 may include any member having an internally threaded opening 174 configured to mate with externally threaded stud 154. In one embodiment, nut 170 includes an integral washer 172; however, as shown in FIG. 7, an integral washer is not necessary where nut 170 has sufficient diameter to compress against bushing 160 or shroud 140.

The interaction of opening 156 and base 152 or bushing 160 are sized to allow for stress transmission through surface engagement. In one embodiment, shown in FIG. 6, bushing 160 has a radially outer surface 168 (relative to center of bushing) having a diameter D same as a diameter of integral washer 172 to provide uniform force distribution; however this is not necessary in all instances.

Figure 8:
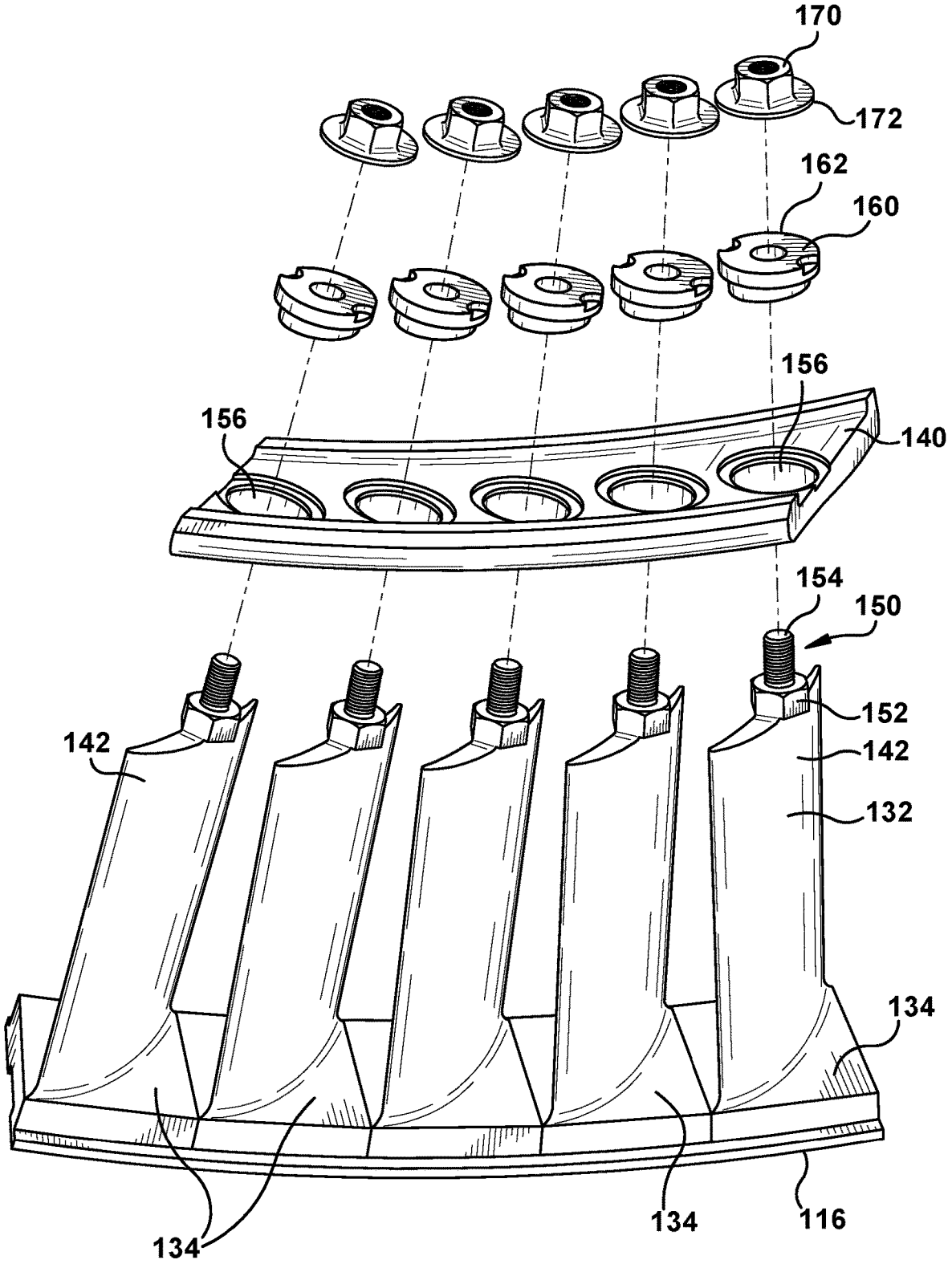
FIG. 8 is an exploded perspective view of an airfoil shroud assembly for a multiple airfoil bodies according to embodiments of the disclosure.

Referring to FIG. 8, as noted, shroud 140 may include a plurality of openings 156, each opening 156 configured to receive a tenon 150 of a respective airfoil body 132. While five openings 156 are shown in shroud 140, any number can be employed. As understood in the art, a number of shrouds 140 can be configured to create a full ring about rotor 110 (FIG. 2), and couple any desired number of individual airfoil bodies 132 into any number of sets of airfoil bodies 132.

A turbomachine 100 according to embodiments of the disclosure may include outer casing 116 surrounding rotor 110, and a plurality of vanes 112 (FIG. 2) coupled to outer casing 116 (FIG. 1) at a radially outer end 134 thereof and extending inwardly toward rotor 110 to a radially inner, free end 142 thereof. Each vane 112 includes: an airfoil body 132 having radially outer, root end 134 coupled to outer casing 116 and extending inwardly toward rotor to radially inner, free end 142, and a tenon 150 extending from radially inner end 142. As noted, tenon 150 includes base 152 and externally threaded stud 154 extending from the base. Shroud 140 includes a plurality of openings 156 to receive base 152 of tenon 150 of each of a set of the plurality of vanes 112. As shown for example in FIG. 6, airfoil shroud assembly 130 may also include bushing 160 having internal opening 162 to receive base 152 of tenon 150, and external surface 164 configured to engage inner surface 158 of opening 156 in shroud 140. As shown in FIG. 8, shroud 140 is installed on free end 142 by placement of opening 156 over base 152 of tenon 150 of airfoil body 132. Where provided, bushing 160 can be positioned over tenon 150 to laterally (e.g., concentrically) position opening 156 about bushing 160 and base 152. A nut 170 threadably couples to each of externally threaded studs 154 on tenons 150 for coupling shroud 140 to the set of plurality of vanes 112. Nut 170 may include integral washer 172.

It will be appreciated that the surfaces of parts such as shroud 140, tenon 150 including base 152 and stud 154, may be angled in any direction desired for ease of installation and/or stress transmission through mating surfaces. Parts of airfoil shroud assembly 130 can be made of any material appropriate for their function, e.g., superalloys, alloys, etc. While tenon 150, bushing 160 and opening 156 in shroud 140 have been shown generally circular, it is understood that the mating surfaces between any two of the components may have different mating shapes, e.g., polygonal: square, rectangular, hexagonal, etc.; oval or otherwise oblong; etc. Further, base 152 and mating first internal opening 162 of bushing 160 can be hexagonal as shown, or may have different mating shapes, e.g., polygonal: square, rectangular, hexagonal, etc.; oval or otherwise oblong; etc.

Embodiments of the disclosure provide an airfoil shroud assembly that can be used for small sized systems with sufficient durability and strength, and still reduce vortex bursting and dampen response due to secondary flow vibration.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. "Optional" or "optionally" means that the subsequently described event or circumstance may or may not occur, and that the description includes instances where the event occurs and instances where it does not.

Approximating language, as used herein throughout the specification and claims, may be applied to modify any quantitative representation that could permissibly vary without resulting in a change in the basic function to which it is related. Accordingly, a value modified by a term or terms, such as "about," "approximately" and "substantially," are not to be limited to the precise value specified. In at least some instances, the approximating language may correspond to the precision of an instrument for measuring the value. Here and throughout the specification and claims, range limitations may be combined and/or interchanged, such ranges are identified and include all the sub-ranges contained therein unless context or language indicates otherwise. "Approximately" as applied to a particular value of a range applies to both values, and unless otherwise dependent on the precision of the instrument measuring the value, may indicate +/−10% of the stated value(s).

The corresponding structures, materials, acts, and equivalents of all means or step plus function elements in the claims below are intended to include any structure, material, or act for performing the function in combination with other claimed elements as specifically claimed. The description of the present disclosure has been presented for purposes of illustration and description, but is not intended to be exhaustive or limited to the disclosure in the form disclosed. Many modifications and variations will be apparent to those of ordinary skill in the art without departing from the scope and spirit of the disclosure. The embodiment was chosen and described in order to best explain the principles of the disclosure and the practical application, and to enable others of ordinary skill in the art to understand the disclosure for various embodiments with various modifications as are suited to the particular use contemplated.

What is claimed is:

1. An assembly, comprising:

an airfoil body including a root end, a free end and a tenon extending from the free end, the tenon including a base and an externally threaded stud extending from the base, wherein the base of the tenon is wider than the externally threaded stud;

a shroud including an opening configured to receive the base of the tenon;

a nut configured to be threadably coupled to the externally threaded stud on the tenon on the airfoil body to couple the shroud to the airfoil body, the nut including an integral washer; and a bushing having a first internal opening to receive the base of the tenon and for concentrically positioning the base of the tenon within the opening in the shroud, a second internal opening allowing the externally threaded stud to pass therethrough, wherein the first internal opening is wider than the second internal opening, and an external surface configured to engage an inner surface of the opening in the shroud, wherein the bushing has a radially outer surface having a diameter the same as a diameter of the integral washer.

2. The assembly of claim 1, wherein the root end is configured to be coupled to an outer casing of a turbomachine, and the free end extends radially inward toward a rotor of the turbomachine.

3. The assembly of claim 1, wherein the shroud includes a plurality of the openings, each opening configured to receive the base of the tenon of a respective airfoil body.

4. A vane for a turbomachine, the vane comprising:

an airfoil body including a free end and a root end, the root end configured to be mounted to an outer casing of the turbomachine;

a tenon extending from a free end of the airfoil body, the tenon including a base configured to be received in an opening in a shroud and an externally threaded stud extending from the base, wherein the base of the tenon is wider than the externally threaded stud;

a nut configured to be threadably coupled to the externally threaded stud on the tenon on the airfoil body to couple the shroud to the airfoil body, the nut including an integral washer; and a bushing having a first internal opening to receive the base of the tenon and for concentrically positioning the base of the tenon within the opening in the shroud, a second internal opening allowing the externally threaded stud to pass therethrough, wherein the first internal opening is wider than the second internal opening, and an external surface configured to engage an inner surface of the opening in the shroud, wherein the bushing has a radially outer surface having a diameter the same as a diameter of the integral washer.

5. An assembly, comprising:

a vane including an airfoil body including a root end, a free end and a tenon extending from the free end, wherein the root end is configured to be coupled to an outer casing of a turbomachine, and the free end extends radially inward toward a rotor of the turbomachine, and wherein the tenon includes a base and an externally threaded stud extending from the base, wherein the base of the tenon is wider than the externally threaded stud;

a shroud including an opening;

a bushing having a first internal opening to receive the base of the tenon and for concentrically positioning the base of the tenon within the opening in the shroud, a second internal opening allowing the externally threaded stud to pass therethrough, wherein the first internal opening is wider than the second internal opening, and an external surface configured to engage an inner surface of the opening in the shroud; and a nut configured to be threadably coupled to the externally threaded stud on the tenon on the airfoil body to couple the shroud to the airfoil, the nut including an integral washer, wherein the bushing has a radially outer surface having a diameter the same as a diameter of the integral washer.

6. The assembly of claim 5, wherein the vane includes a plurality of vanes, and the shroud includes a plurality of the openings, each opening configured to receive the base of the tenon of a respective airfoil body of a respective vane.

* * * * *